US007695286B2

(12) United States Patent
Swart et al.

(10) Patent No.: US 7,695,286 B2
(45) Date of Patent: Apr. 13, 2010

(54) SEMICONDUCTOR ELECTROMECHANICAL CONTACT

(75) Inventors: Mark Swart, Villa Park, CA (US); John Ellis, San Dimas, CA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 12/204,741

(22) Filed: Sep. 4, 2008

(65) Prior Publication Data

US 2009/0075497 A1 Mar. 19, 2009

Related U.S. Application Data

(60) Provisional application No. 60/973,358, filed on Sep. 18, 2007.

(51) Int. Cl.
*H01R 12/00* (2006.01)

(52) U.S. Cl. ..... 439/66

(58) Field of Classification Search ..... 439/66
See application file for complete search history.

(56) References Cited

U.S. PATENT DOCUMENTS

| | | | |
|---|---|---|---|
| 4,593,961 | A | 6/1986 | Cosmo |
| 4,647,124 | A | 3/1987 | Kandybowski |
| 5,069,629 | A | 12/1991 | Johnson |
| 5,098,311 | A | 3/1992 | Roath et al. |
| 5,207,584 | A | 5/1993 | Johnson |
| 5,342,205 | A | 8/1994 | Hashiguchi |
| 5,520,545 | A | 5/1996 | Sipe |
| 5,899,755 | A | 5/1999 | Kline |
| 5,903,059 | A | 5/1999 | Bertin et al. |
| 5,975,916 | A | 11/1999 | Okura |
| 6,004,141 | A | 12/1999 | Abe et al. |
| 6,019,612 | A | 2/2000 | Hasegawa et al. |
| 6,540,529 | B1 | 4/2003 | Yu |
| 6,729,890 | B2 | 5/2004 | Shin |
| 6,749,440 | B1 | 6/2004 | Szu et al. |
| 6,793,504 | B2 | 9/2004 | Noda et al. |

(Continued)

FOREIGN PATENT DOCUMENTS

| | | |
|---|---|---|
| JP | 2-295082 | 12/1990 |

(Continued)

OTHER PUBLICATIONS

International Search Report and Written Opinion for Application No. PCT/US08/76706; date mailed Nov. 24, 2008; search and opinion completed Nov. 7, 2008; 6 pages.

(Continued)

*Primary Examiner*—Briggitte R Hammond
(74) *Attorney, Agent, or Firm*—Christie, Parker & Hale, LLP.

(57) ABSTRACT

A compliant electrical contact assembly for interconnecting a lead or terminal of an integrated circuit having two cantilever beams positioned within a slot in a housing arranged such that a portion of the beams slide along a portion of one another and within the housing as the beams are deformed elastically in order to allow more travel and compliance without yielding or totally deforming the beam. The sliding action during deformation effectively multiplies the total compliance in the assembly above and beyond the compliance otherwise available to elastic compression of the cantilever beams.

15 Claims, 3 Drawing Sheets

U.S. PATENT DOCUMENTS

| | | | | |
|---|---|---|---|---|
| 6,814,585 | B2 | 11/2004 | Bedell et al. | |
| 6,827,588 | B1 | 12/2004 | Huang et al. | |
| 6,854,981 | B2 | 2/2005 | Nelson | |
| 6,902,411 | B2 | 6/2005 | Kubo | |
| 6,921,270 | B2 | 7/2005 | Mendenhall et al. | |
| 7,052,284 | B2 | 5/2006 | Liao et al. | |
| 7,121,841 | B2 | 10/2006 | Alger et al. | |
| 7,121,842 | B2 | 10/2006 | Kimura | |
| 7,186,119 | B2 | 3/2007 | Perugini | |
| 7,195,495 | B2 | 3/2007 | Takano et al. | |
| 7,226,295 | B1 | 6/2007 | Ju | |
| 7,473,104 | B1 * | 1/2009 | Wertz | 439/66 |
| 2004/0171285 | A1 | 9/2004 | Okura | |
| 2007/0020967 | A1 | 1/2007 | Midorikawa | |
| 2007/0054515 | A1 | 3/2007 | Williams | |
| 2007/0141867 | A1 | 6/2007 | Kishi et al. | |
| 2007/0161267 | A1 | 7/2007 | Ott et al. | |

FOREIGN PATENT DOCUMENTS

| | | |
|---|---|---|
| JP | 5-17946 | 3/1993 |
| JP | 5-226043 | 9/1993 |
| JP | 6-196232 | 7/1994 |
| JP | 10-125428 | 5/1998 |
| JP | 11-54224 | 2/1999 |
| JP | 11-102761 | 4/1999 |
| JP | 11-512229 | 10/1999 |
| JP | 2000-100500 | 4/2000 |
| JP | 2000-331767 | 11/2000 |
| JP | 2001-60483 | 3/2001 |
| JP | 2004-534366 | 11/2004 |
| JP | 2007-503103 | 2/2007 |

OTHER PUBLICATIONS

Partial Translations for Cite Nos. 2-13, listed under Foreign Patent Documents, pp. 2-8.

Patent Abstract for Japan Publication No. 2000-331767, retrieved from *esp@cenet* on Oct. 18, 2007.

Patent Abstracts of Japan, Publication No. 02-295082, Date of Publication Dec. 5, 1990, in the name of Grabbe.

Patent Abstracts of Japan, Publication No. 05-226043, Date of Publication Sep. 3, 1993, in the name of Baumberger et al.

Patent Abstracts of Japan, Publication No. 06-196232, Date of Publication Jul. 15, 1994, in the name of Okuyama.

Patent Abstracts of Japan, Publication No. 10-125428, Date of Publication May 15, 1998, in the name of Saito.

Patent Abstracts of Japan, Publication No. 11-054224, Date of Publication Feb. 26, 1999, in the name of Urano.

Patent Abstracts of Japan, Publication No. 11-102761, Date of PublicationApr. 13, 1999, in the name of Hashiguchi et al.

Patent Abstracts of Japan, Publication No. 2000-100500, Date of Publication Apr. 7, 2000, in the name of Sakata et al.

Patent Abstracts of Japan, Publication No. 2001-060483, Date of Publication Mar. 6, 2001, in the name of Takahashi et al.

Abstract retrieved from *Thomson Dialog* database for Japan Publication No. 11-512229, printed Aug. 26, 2008.

Abstract retrieved from *Thomson Dialog* database for Japan Publication No. 2004-534366, printed Aug. 26, 2008.

Abstract retrieved from *Thomson Dialog* database for Japan Publication No. 2007-503103, printed Aug. 26, 2008.

* cited by examiner

SEMICONDUCTOR ELECTROMECHANICAL CONTACT

CROSS-REFERENCE TO RELATED APPLICATION(S)

This application claims priority to U.S. provisional application Ser. No. 60/973,358 filed Sep. 18, 2007.

FIELD OF THE INVENTION

The present invention relates to the field of electrical interconnect systems and more specifically to a device for interconnecting the leads of an integrated circuit with corresponding terminals on a printed circuit board interfacing with a tester intended to effect test analysis of the integrated circuit device.

BACKGROUND OF THE INVENTION

Many applications exist for effecting electrical contact between two conductors. An application includes interconnection between the leads of an integrated circuit device and conductive pads or terminals on a printed circuit board which serves as an interface between the integrated circuit device under test and the tester apparatus.

Both electrical and mechanical considerations are necessary to design an interconnect between an integrated circuit and the printed circuit board, also known as a load board. One of the mechanical considerations to be taken into account in designing an interconnect system is that a wiping action should be accomplished between the contact itself and the lead of the integrated circuit by which the contact is engaged. The wiping action functions to effect maximization of effective contact in view of oxide build-up which can occur on the lead of integrated circuit. In effect, the wiping action enables a good interface to be accomplished between the contact and the lead of the integrated circuit. Electrical considerations for such an electrical interconnect contact system include that the contact should be a high-speed, short path device. In addition, the contact should have a low inductance without having a controlled impedance requirement.

One example of an electrical interconnect contact system designed to address the problems associated with designing an interconnect between the leads of an integrated circuit device and a printed circuit board is shown in U.S. Pat. No. 5,069,629. The electrical interconnect assembly disclosed in the '629 patent includes a housing which is interposed between the lead of the integrated circuit and the corresponding spaced terminal of the printed circuit board. The housing is provided with slots extending from a first surface to an opposite surface and has troughs formed on the surfaces of the housing. A first rigid element is received in the trough formed on one surface and extends across slots in which one or more contacts are received. An elastomeric second element is received in the trough formed in the second surface of the housing and extends across the slots in which contacts are received. The elastomeric elements are provided with the measure of compressability and tensile extendability. A planer contact is received within the slots and has a protruding contact surface extending from either end to contact the lead of the integrated circuit and the pad on the printed circuit board.

Disadvantages with the design embodied in the '629 patent is that the contact provides an extremely small amount of travel, 0.008 inches, which leaves little room for error. This is particularly problematic when you consider there is a very small amount of room available for interconnection between the leads on an integrated circuit and the contact pads on the load board. A second disadvantage is that the load board is quickly worn out because of wiping action of the device at both the integrated circuit lead and the load board pads. Considering the integrated circuits are continually cycling through the test and being changed a single wipe is advantageous, however, the load board is continually used throughout the repeated testing of integrated circuits and therefore the constant wiping wears out the load board.

Consequently, a need exists for a semiconductor electromechanical contact which addresses the problems associated with prior contact devices and is inexpensive to manufacture.

SUMMARY OF THE INVENTION

The present invention is a compliant semiconductor electromechanical contact assembly for interconnecting a lead or terminal of an integrated circuit or other device to a corresponding terminal spaced some distance apart, typically a pad on a printed circuit board or load board for test apparatus. The assembly comprises one or more cantilever beams which are arranged in such a way that some portion of the beam slides along a portion of another beam or a portion of the housing of the assembly as it is deformed elastically in order to allow more travel and compliance without yielding or deforming the beam. This sliding action during deformation effectively multiplies the total compliance in the assembly above and beyond the compliance otherwise available due to simple elastic compression of the cantilever beam member.

One embodiment of the present invention consists of an assembly of two independent beams in a rectangular slot of a housing. Each beam is folded from typically rectangular stock to result in two sections separated by an acute angle. The two beams are inserted into the slot in such a way that one section of each beam slides along opposite walls of the slot and the other section of each beam meets in the center of the slot at an angle relative to the walls the first section slides against. In this configuration, the section of the beams in contact with each other both deflect and slide against each other as the beams are forced together into the slot. The deformation of the beams results in a lateral force pushing each beam against the boundary of the slot upon which it slides and a force in the direction opposite to the direction of motion of the beam.

The two conductive beams are placed in the slot in a plastic housing, and can include a metal cage which may be used to short out an otherwise longer electrical path through the total length of each contact.

The two cantilevered beams are compressed as they slide against one another and increase travel distances up to 0.035 inches of travel. The two plungers can be offset or aligned in the slots in the housing. Another advantage of the present invention is that it eliminates the multiple wiping that occurs on the load board. When the cantilever beams are compressed, the test pad on the load board is wiped once and held in contact as multiple integrated circuits are tested.

DETAILED DESCRIPTION OF THE INVENTION

Figure 1:
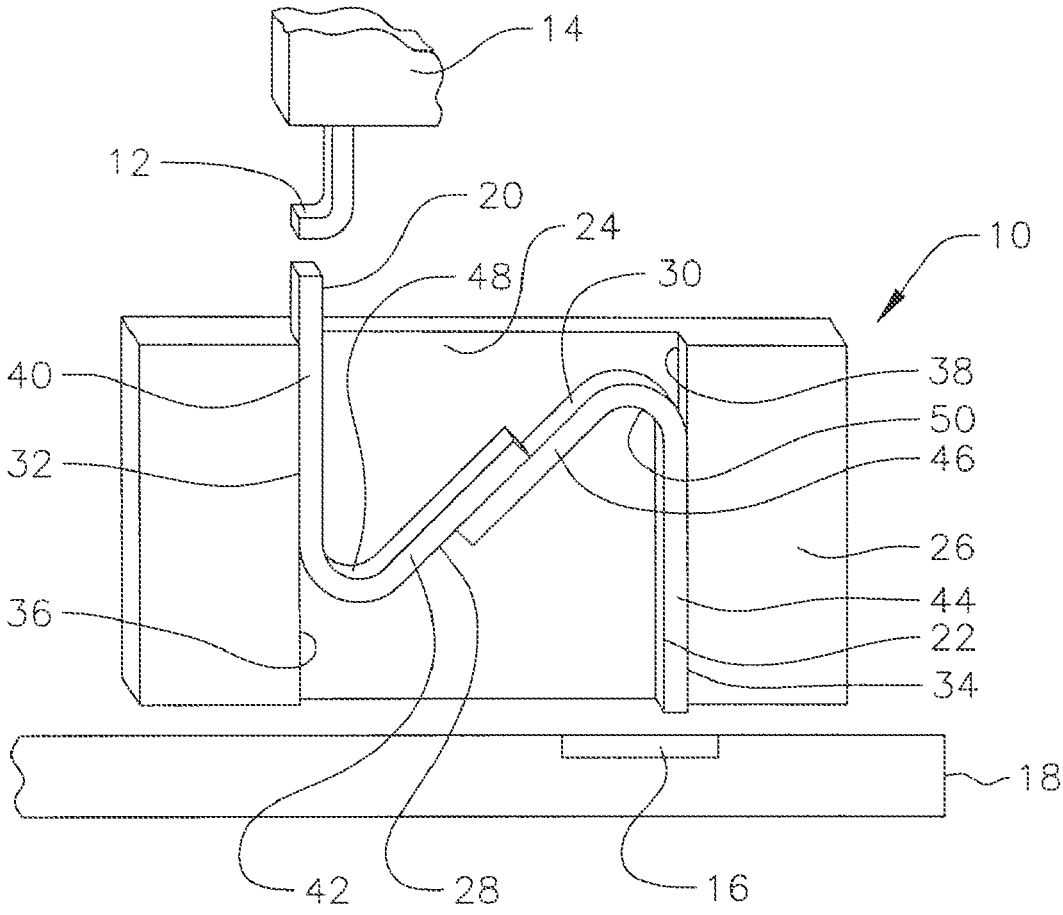
FIG. 1 is a partial perspective view of the electromechanical contact of the present invention.

Referring to FIG. 1, a compliant semiconductor electromechanical contact assembly 10 of the present invention is illustrated. The assembly 10 is for interconnecting a lead or terminal 12 of an integrated circuit 14 or other device to a corresponding terminal spaced a distance apart from the integrated circuit. For example, in FIG. 1, the terminal is a test pad 16 on a printed circuit board, commonly known as a load board 18. The assembly 10 comprises pairs of cantilever beams 20 and 22 positioned within a slot 24 in a housing 26. It is to be understood that although housing 26 illustrates a single slot 24 and one pair of cantilever beams 20, 22, there can be multiple pairs of cantilever beams in spaced apart slots within housing 26 depending upon the number of leads 12 for a particular integrated circuit 14 being tested. Beams 20 and 22 are arranged within the slot 24 such that a portion of sliding surfaces 28 and 30 slide along one another during compression of the beams. The beams deform elastically in order to allow more travel and compliance of the beams without yielding or total deformation. The sliding action during compression effectively multiplies the total compliance in the assembly above and beyond the compliance otherwise available due to elastic compression of the member.

The embodiment illustrated in FIG. 1 includes two independent beams positioned in a rectangular slot. Each beam is folded from rectangular stock to result in two sections 40 and 42 of beam 20, and 44 and 46 of beam 22. Each of the sections are separated by an acute angle bend 48 and 50. The two beams are inserted into the slot in such a way that one section 40, 44 of each beam slides along opposing walls 36, 38 of the slot and the other section 42, 46 of each beam meets in the center of the slot at an angle relative to the walls the first section slides against. In this configuration, the sections 42, 46 of the beams in contact with each other both deflect and slide against each other as the beams are forced together into the slot during compression. The deformation of the beams results in a lateral force pushing each beam against the side walls 36 and 38 of the slot upon which it slides in a force in the direction opposite to the direction of motion of the beam.

Alternatively, walls 36 and 38 can be placed at a small angle with respect to the leads 12 or test pad 16, or forming a parallelogram with those external contacts so that a relative sliding motion also exists between the beams and the external contacts. The beams are ideally made from a semi-precious alloy such as Palliney 6, instead of a more common plated electrical contact material, so that friction and rubbing between the beams does not result in immediate wear of the plated surfaces which would result in higher electrical resistance between the components and the external leads or leads in contact with the assembly. Typically the housing 26 is made of a plastic or other non-conductive material.

Figure 2:
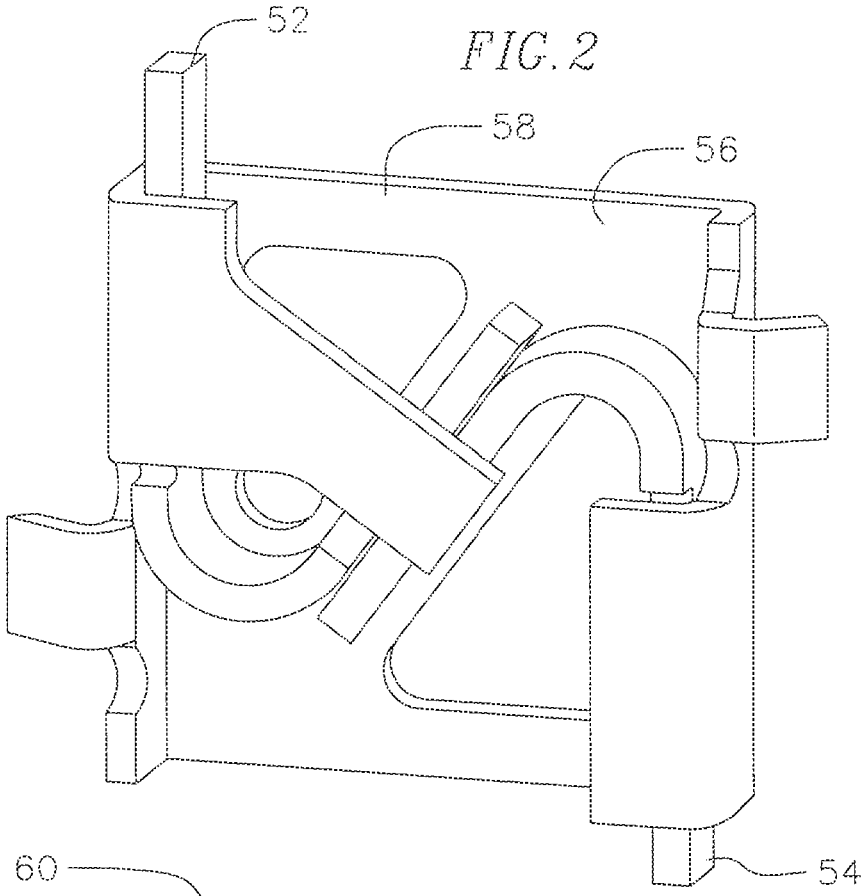
FIG. 2 is a perspective of an alternative embodiment of the contact of FIG. 1.
Figure 3:
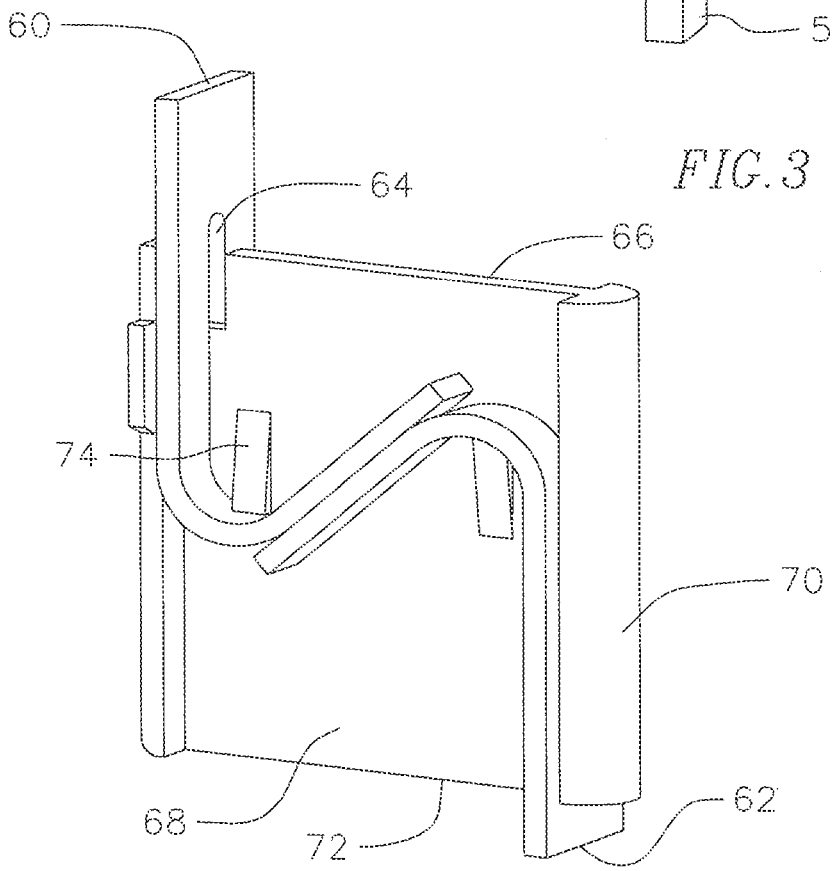
FIG. 3 is a second alternative embodiment of the contact of FIG. 1.

Referring to FIG. 2, an alternative embodiment housing arrangement is illustrated. In this embodiment beams 52 and 54 are positioned within a slot 56 of a metal cage 58 which would then be placed within a slot in the housing shown in FIG. 1. The metal cage may be used to short out an otherwise longer electrical path through the total length of each contact. FIG. 3 illustrates yet another alternative embodiment arrangement wherein beams 60 and 62 are wider and have a slot 64 extending through a portion of beams such that the beam can straddle a wall 66 of cage 68. Cage 68 has an end wall 70 which would be inserted into the slot in the housing shown in FIG. 1. In this embodiment, case 68 includes tangs 72 and 74 positioned along wall 66 to help guide beams 60 and 62 during deformation.

Figure 4:
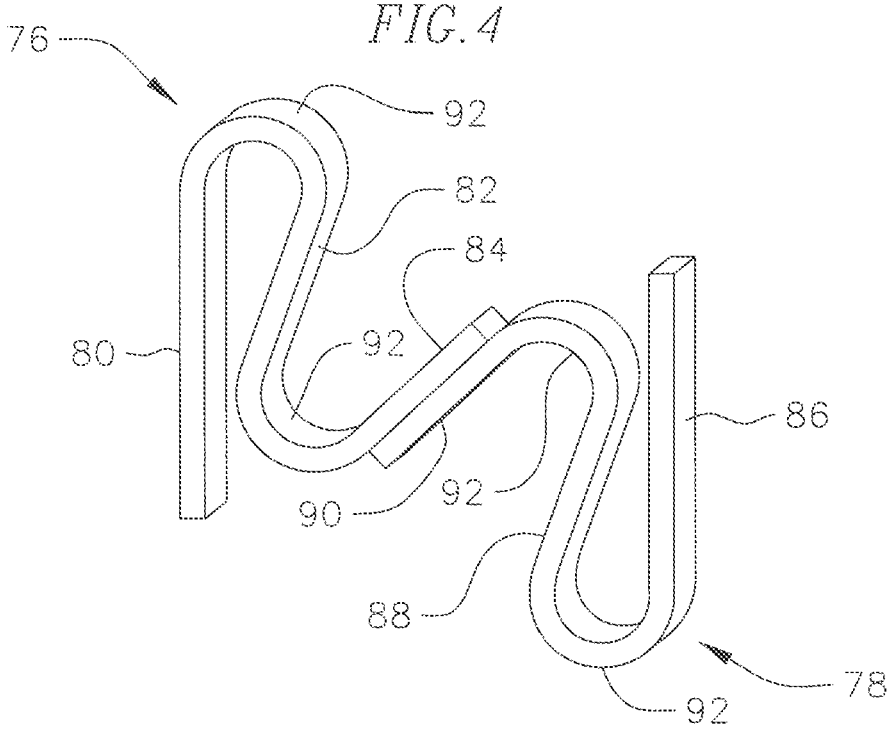
FIG. 4 is a perspective view of an alternative cantilever beam design of the contact of FIG. 1.
Figure 5:
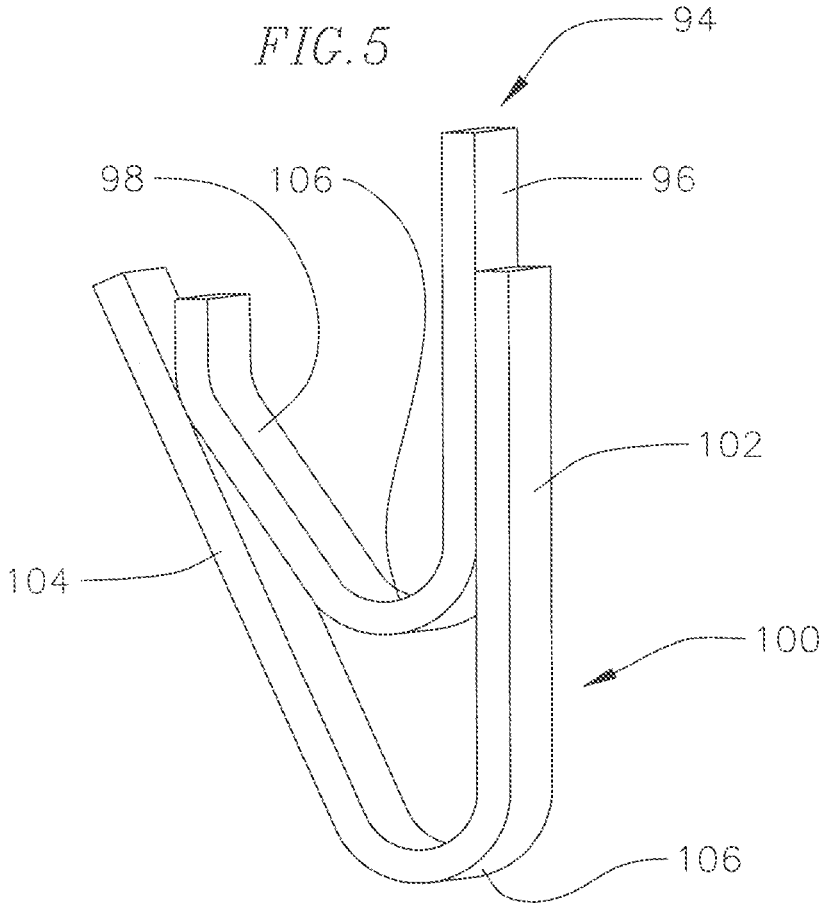
FIG. 5 is a perspective view of a second alternative cantilever beam design of the contact of FIG. 1.

FIG. 4 illustrates an alternative and complex beam shape wherein beams 76 and 78 include three sections, namely 80, 82 and 84 for beam 76 and 86, 88, and 90 for beam 78. Each of the individual sections of each beam are connected by an acute angle bend 92. FIG. 5 illustrates yet an alternative beam design for applications whereas it is desired to have no lateral offset of the contact terminals, only vertical offset. In FIG. 5, beam 94 has a first section 96 and a second section 98 and beam 100 also includes a first section 102 and second section 104. Each of the sections of both beams are connected by an acute angle bend 106. Although the beam configurations illustrated in the drawings are of rectangular cross-section, it is to be understood that other geometries are also possible, including round and square configurations.

The two beams can be offset are aligned in the housing. And the arrangement provides for a larger force for the amount of travel for the beams. In the arrangement shown in FIGS. 2 and 3, the cage can wrap around the beams as shown in FIG. 2 or the beams can be bifurcated as shown in FIG. 3 such that they ride upon the cage. As indicated the cages would be stacked up in sockets in the housing to minimize capacitance and increase speed.

Although the present invention has been described and illustrated with respect to specific embodiments thereof, it is to be understood that it is not to be so limited and can include changes in modifications such as the contact assembly being used as a spring, as an interconnect, or as a test contact. These and other features of the invention and the scope of the invention is defined as hereinafter claimed.

What is claimed is:

1. An electromechanical contact assembly comprising:

a housing having at least one slot; and two cantilever beam contact elements positioned within the slot which elastically deform under compression by a portion of the contact elements sliding along one another and within sidewalls of the slot non-normally to a direction of deformation thus multiplying an effective compliance of the assembly so that it is larger than an actual deformation of the contact elements, and each of the cantilever beam contact elements having a contact tip sliding against a sidewall of the slot and extending out of the slot horizontally spaced from one another.

2. The assembly of claim 1 wherein each contact element is a beam having an acute bend to form a first sliding surface and a second sliding surface wherein the first sliding surface of a first beam is adjacent a first sliding surface of a second beam.

3. The assembly of claim 1 wherein the two contact elements are contained within a conductive cage positioned within the slot of the housing.

4. The assembly of claim 1 wherein the two contact elements contain a slot for positioning the contact elements on a conductive plate within the slot.

5. The assembly of claim 1 wherein the contact elements are a beam having multiple sections separated by acute bends.

6. The assembly of claim 1 wherein the two contact elements are configured to be aligned within the slot in the housing.

7. The assembly of claim 1 wherein the two contact elements are configured to be offset within the slot in the housing.

8. The assembly of claim 1 wherein the two contact elements extend from the slot in the housing at an angle.

9. A test socket for an integrated circuit package comprising:

a housing have a plurality of slots, each slot having opposite sidewalls;

a first contact element having a contact tip and a second contact element having a contact tip positioned within the slot sliding against a sidewall of the slot wherein each contact element is a cantilever beam having at least two sections formed by an acute angle bend and the contact tip of the first contact element extends out of the slot and is horizontally spaced from the contact tip of the second contact element which extends out of an opposite side of the slot; and a load board having test pad locations for one of the first contact element or the second contact element such that during compression of the first contact element and the second contact element each of the first contact element and the second contact element slide upon one another and along the sidewalls of the slot.

10. The test socket of claim 9 wherein each of the first contact element and the second contact element has a first sliding surface and a second sliding surface wherein the first sliding surfaces are adjacent to one another and the second sliding surfaces are adjacent opposite sidewalls.

11. The test socket of claim 9 wherein the first contact element and the second contact element are contained within a conductive cage positioned within each slot of the housing.

12. The test socket of claim 9 wherein the first contact element and the second contact element are positioned on a conductive plate within each slot in the housing.

13. The test socket of claim 9 wherein the first contact element and the second contact element have multiple sections separated by acute bends.

14. The test socket of claim 9 wherein the first contact element and the second contact element is a cantilever beam having a rectangular cross-section.

15. The test socket of claim 9 wherein the first contact element and the second contact element are a cantilever beam having a circular cross-section.

* * * * *